United States Patent [19]

Riffle et al.

[11] Patent Number: 4,946,113

[45] Date of Patent: Aug. 7, 1990

[54] WIRE REEL CARRIER

[76] Inventors: Charles E. Riffle; Douglas Riffle, both of Rte. 1 Box 152, Cutler, Ohio 45724

[21] Appl. No.: 321,005

[22] Filed: Mar. 9, 1989

[51] Int. Cl.[5] ..... B65H 75/40; B60D 1/00

[52] U.S. Cl. ..... 242/86.5 R; 242/68.4; 242/75.4; 280/449; 172/269

[58] Field of Search ..... 242/86.5 R, 86.5 A, 242/129.5, 125.6, 86, 68.4, 75.4, 106; 254/323, 330, 413; 280/449; 172/269, 70

[56] References Cited

U.S. PATENT DOCUMENTS

| | | | |
|---|---|---|---|
| 1,952,565 | 3/1934 | Redwour | 280/449 |
| 2,126,970 | 8/1938 | Mossberg | 242/118.5 |
| 2,144,989 | 1/1939 | Mossberg | 242/118.5 |
| 2,432,125 | 12/1947 | Schlaak | 172/269 |
| 2,452,796 | 11/1948 | Skibsted | 280/449 |
| 2,496,402 | 2/1950 | McVeigh et al. | 242/118.5 |
| 2,563,001 | 8/1951 | Bergstrom et al. | 242/118.5 |
| 2,645,073 | 7/1953 | Dalglish et al. | 172/269 |
| 3,022,835 | 2/1962 | Jennings | 172/269 |
| 4,339,096 | 7/1982 | May | 242/86.5 R |

*Primary Examiner*—Stuart S. Levy

*Assistant Examiner*—Steven M. duBois

*Attorney, Agent, or Firm*—Jerry T. Kearns

[57] ABSTRACT

A wire reel carrier for use in stringing barbed wire for fencing is designed for attachment to a horizontal cargo rack of an all terrain vehicle. The wire reel carrier includes a pair of spaced frame rails secured by a plurality of clamps to the cargo rack. An elongated rod dimensioned for insertion through the hollow core of a wire roll extends transversely between the frame rails. A pair of retaining plates, each secured by a frictional collar, maintain the wire roll in correct orientation on the transverse rod. A pair of safety latches secure opposite ends of the rod to respective frame rails and include a safety mechanism for releasing the rod from the frame rails upon exertion of an excess force on the rod by a wire being strung from a roll supported on the rod. This prevents the occurrence of severe accidents and possible injury to the ATV operator upon tangling of the wire. The safety latches are formed from a spring steel strip which clamps an end portion of the rod between the strip and the frame rail. A rearward end of the strip terminates in an upwardly extending lever for releasing the rod from clamping engagement for purposes of installing a wire roll on the rod.

9 Claims, 3 Drawing Sheets

WIRE REEL CARRIER

BACKGROUND OF THE INVENTION

1. Field of the Invention

The present invention relates to wire reel carriers, and more particularly pertains to a new and improved wire reel carrier adapted for use in stringing barbed wire during a fencing operation. Many ranchers and farmers utilize three and four wheeled all terrain vehicles for performing various farming and ranching operations. The present invention allows a single individual to string barbed wire from a roll during a fencing operation by providing a wire reel carrier for attachment to a conventional ATV horizontal cargo rack. To prevent accidents and possible injury to the ATV operator, the present invention provides a safety mechanism which releases the wire roll supporting rod in the event of tangling of the wire or the exertion of other undue forces upon the wire roll supporting rod.

2. Description of the Prior Art

Various types of wire reel carriers are known in the prior art. A typical example of such a wire reel carrier is to be found in U.S. Pat. No. 3,764,031, which issued to E. Parsen on Oct. 9, 1973. This patent discloses a trailer assembly which may be easily converted to carry various sized cable wheels or small construction equipment such as a trencher. The assembly includes an axle portion with a pair of telescopic rear portions, a telescopic tongue portion for pulling the axle portion and a pair of channel-shaped rails for transporting the equipment. U.S. Pat. No. 3,856,230, which issued to E. Zimmer on Dec. 24, 1974, discloses a wire dispensing dolly which includes a pair of spaced frame rails having a series of aligned notches for supporting a plurality of spaced wire roll supporting rods. U.S. Pat. No. 4,190,211, which issued to H. Janzen on Feb. 26, 1980, discloses a device for mounting a reel of wire on a truck bed which includes a pair of brackets mountable at opposite sides of the bed and adapted to support an elongated shaft at spaced locations therealong. A friction braking assembly includes a rotatable friction element adapted to be keyed to a reel rotatably supported on the shaft. U.S. Pat. No. 4,339,096, which issued to A. May on July 13, 1982, discloses a cable laying apparatus for use with agricultural tractors equipped with a rear three-point hydraulically operated hitch. The device includes a supporting frame for lifting, carrying and unwinding heavy spools of barbed wire for laying fences. U.S. Pat. No. 4,437,622, which issued to M. Heider on Mar. 20, 1984, discloses a wire roller which includes a wire receiving spool rotatably supported on a frame adapted for securement on a vehicle. An electric motor supported on the frame includes drive means for rotating the spool. The frame may be secured on a vehicle by a clamping assembly including a pair of co-acting clamp jaws. A torque applicator is operatively associated with one clamp jaw for pivotally moving the clamp jaws into clamping engagement on a vehicle bumper.

While the above mentioned devices are suited for their intended usage, none of these devices discloses a wire reel carrier designed for mounting on the horizontal cargo rack of an all terrain type vehicle. Additionally, none of the aforesaid devices disclose a wire reel carrier for stringing barbed wire during a fencing operation which includes a safety mechanism for releasing a wire spool supporting rod upon occurrence of excessive forces due to tangling of the wire. Inasmuch as the art is relatively crowded with respect to these various types of wire reel carriers, it can be appreciated that there is a continuing need for and interest in improvements to such wire reel carriers, and in this respect, the present invention addresses this need and interest.

SUMMARY OF THE INVENTION

In view of the foregoing disadvantages inherent in the known types of wire reel carriers now present in the prior art, the present invention provides an improved wire reel carrier. As such, the general purpose of the present invention, which will be described subsequently in greater detail, is to provide a new and improved wire reel carrier which has all the advantages of the prior art wire reel carriers and none of the disadvantages.

To attain this, a representative embodiment of the concepts of the present invention is illustrated in the drawings and makes use of a wire reel carrier for use in stringing barbed wire for fencing is designed for attachment to a horizontal cargo rack of an all terrain vehicle. The wire reel carrier includes a pair of spaced frame rails secured by a plurality of clamps to the cargo rack. An elongated rod dimensioned for insertion through the hollow core of a wire roll extends transversely between the frame rails. A pair of retaining plates, each secured by a frictional collar, maintain the wire roll in correct orientation on the transverse rod. A pair of safety latches secure opposite ends of the rod to respective frame rails and include a safety mechanism for releasing the rod from the frame rails upon exertion of an excess force on the rod by a wire being strung from a roll supported on the rod. This prevents the occurrence of severe accidents and possible injury to the ATV operator upon tangling of the wire. The safety latches are formed from a spring steel strip which clamps an end portion of the rod between the strip and the frame rail. A rearward end of the strip terminates in an upwardly extending lever for releasing the rod from clamping engagement for purposes of installing a wire roll on the rod.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wire reel carrier which has all the advantages of the prior art wire reel carriers and none of the disadvantages.

It is another object of the present invention to provide a new and improved wire reel carrier which may be easily and efficiently manufactured and marketed.

It is a further object of the present invention to provide a new and improved wire reel carrier which is of a durable and reliable construction.

An even further object of the present invention is to provide a new and improved wire reel carrier which is susceptible of a low cost of manufacture with regard to both materials and labor, and which accordingly is then susceptible of low prices of sale to the consuming public, thereby making such wire reel carriers economically available to the buying public.

Still yet another object of the present invention is to provide a new and improved wire reel carrier which provides in the apparatuses and methods of the prior art some of the advantages thereof, while simultaneously overcoming some of the disadvantages normally associated therewith.

Still another object of the present invention is to provide a new and improved wire reel carrier which allows conventional all terrain type vehicles to be utilized by a single individual to string a barbed wire fence.

Yet another object of the present invention is to provide a new and improved wire reel carrier which includes a safety mechanism for preventing accident or injury in the event of tangling during a barbed wire fencing operation.

Even still another object of the present invention is to provide a new and improved wire reel carrier which allows a single individual to utilize a conventional all terrain type vehicle to erect a barbed wire fence in a safe and controlled manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
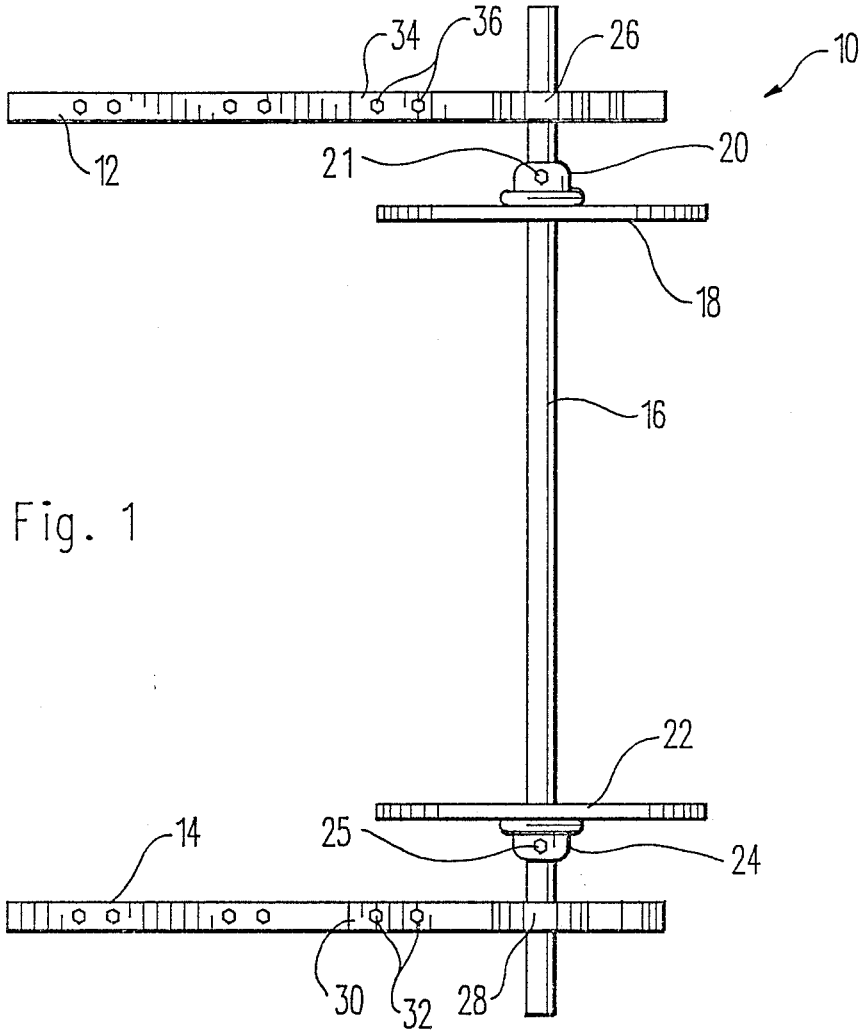
FIG. 1 is a top plan view illustrating the wire reel carrier according to the present invention.

With reference now to the drawings, and in particular to FIG. 1 thereof, a new and improved wire reel carrier embodying the principles and concepts of the present invention and generally designated by the reference numeral 10 will be described.

More specifically, it will be noted that the first embodiment 10 of the invention includes a pair of spaced parallel frame rails 12 and 14. An elongated rod 16 extends transversely between the frame rails 12 and 14 and is secured thereon by a pair of releasable safety latch strips 30 and 34. The safety latch strips 30 and 34 are each formed from an elongated rectangular strip of spring steel which extend in overlying parallel relation with the frame rails 12 and 14. The latch strips 30 and 34 have a first end portion secured to the frame rails 12 and 14 by conventional threaded fasteners 32 and 36. Clamping members 26 and 28 are formed by arcuately bent portions of the strips 34 and 30 which retain opposite end portions of the rod 16 in frictional clamping engagement against the frame rails 12 and 14. A pair of circular retaining plates 18 and 22 each have a central aperture which receives the cylindrical rod 16. The retaining plates 18 and 22 are constrained against outward lateral movement by collars 20 and 24 which are secured in an adjusted position on the rod 16 by tightening of set screws 21 and 25. In use, a conventional roll of wire is rotatably supported on the rod 16, between the retaining plates 18 and 22.

Figure 2:
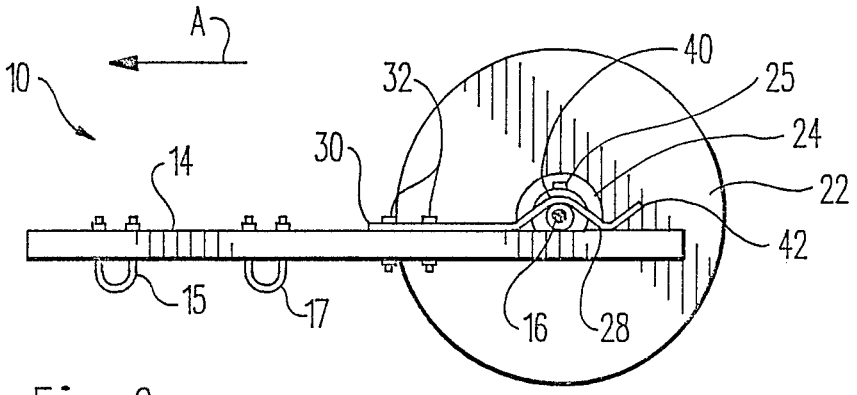
FIG. 2 is a side view illustrating the wire reel carrier.

As shown in FIG. 2, each of the side frame rails include a pair of spaced U-bolt clamping members 15 and 17 for engagement with the horizontal tubular frame members of a conventional ATV cargo rack. Safety latch strip 30 has an arcuately upwardly bent portion 28 which defines a clamping member having an inner surface 40 in frictional engagement with the rod 16. The rod 16 is thus clamped against the upper surface of the frame rail 14. In use, the rear end portion 42 of the latch strip 30 faces toward the rear of the vehicle upon which the frame rails 12 and 14 are secured. In order to remove the rod 16, the rear end portion 42 forms an upwardly bent lever which allows the clamping member 28 to be disengaged from the rod 16. This allows a roll of wire to be installed on the rod 16. During a fence stringing operation, an individual secures the free end of the wire roll mounted on the rod 16 to a stationary fence post and then drives the supporting ATV vehicle in the direction indicated by the arrow A. If the free rotation of the supported wire roll is frozen, for example by tangling of the wire, an excess force will be transmitted to the supporting rod 16. If the supporting rod were rigidly secured to the frame rails 12 and 14, this would transmit the excess force directly to the ATV and could result in an accident and injury to the operating individual. However, because the rear end portion 42 of the safety latch strip 30 is not secured rigidly to the rear end portion of he frame rail 14, the free rear end portion 42 will move upwardly, away from the rail 14 allowing the rod 16 to be released from the clamping portion 28. This prevents an extreme jerking force from being transmitted to the supporting rails 12 and 14 and subsequently to the vehicle. Because the strip 30 is formed from a spring steel material, the rear end portion 42 will return to the illustrated position after release of the rod 16. The rod 16 and supported wire roll may then be reinstalled after correcting the initial tangle.

Figure 3:
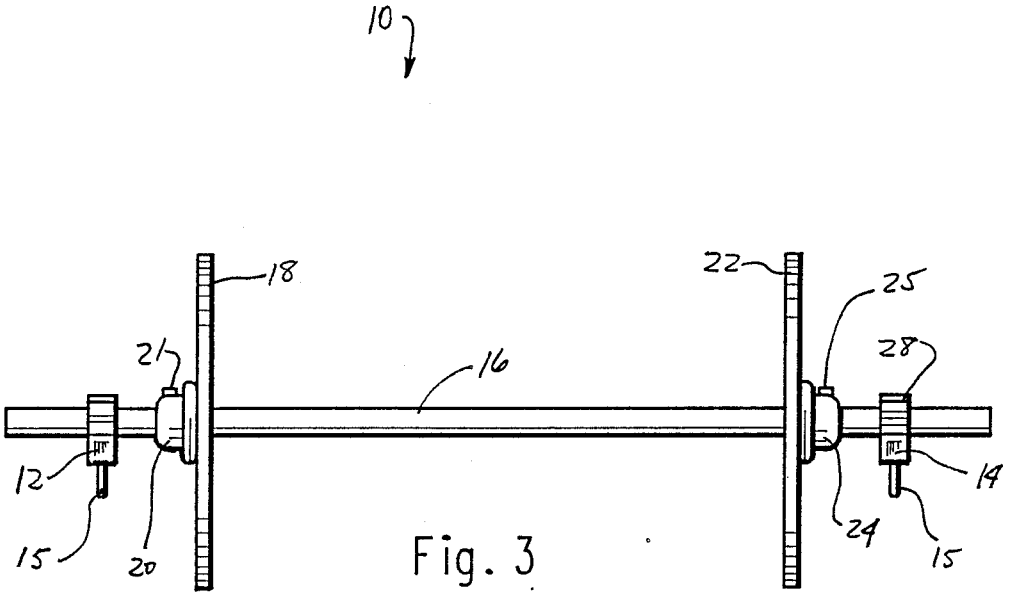
FIG. 3 is a front end view of the wire reel carrier.

FIG. 3 illustrates the transverse rod 16 extending between the frame rails 12 and 14.

Figure 4:
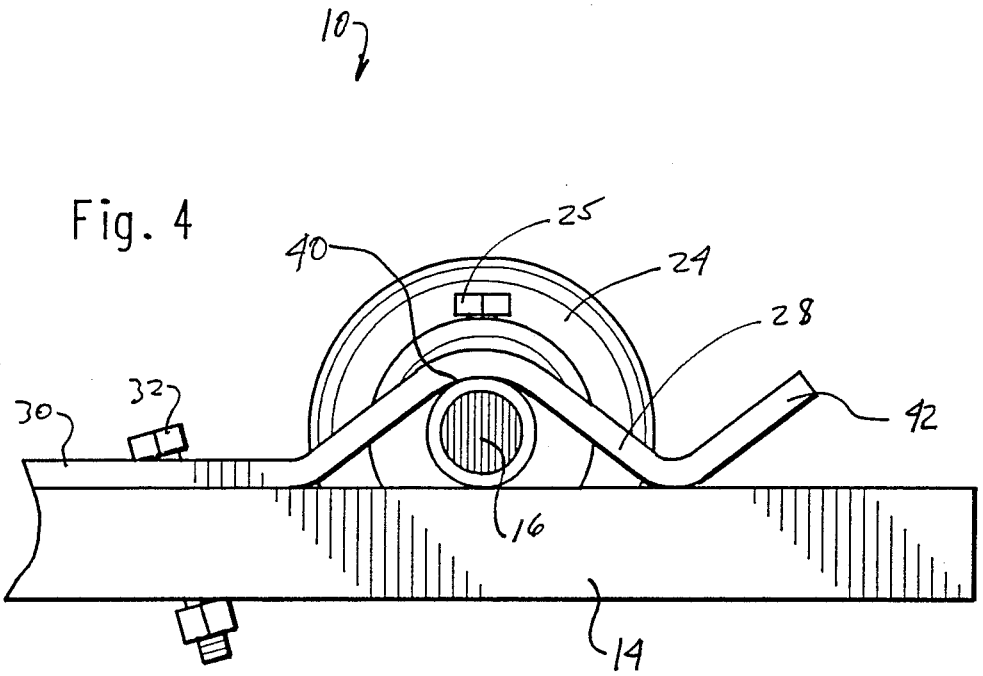
FIG. 4 is an enlarged detail view illustrating the safety latch mechanism which releasably secures the wire roll supporting rod.

FIG. 4 is an enlarged detail view which further illustrates the safety latch strip 30. The upwardly bent lever portion 42 of the strip 30 may be moved manually upwardly to release the rod 16 or may be pried upwardly through the use of a suitable implement, if required. The thickness and material characteristics of the spring steel strip 30 may be varied, depending upon the desired release force required before release of the rod 16 from clamping engagement.

Figure 5:
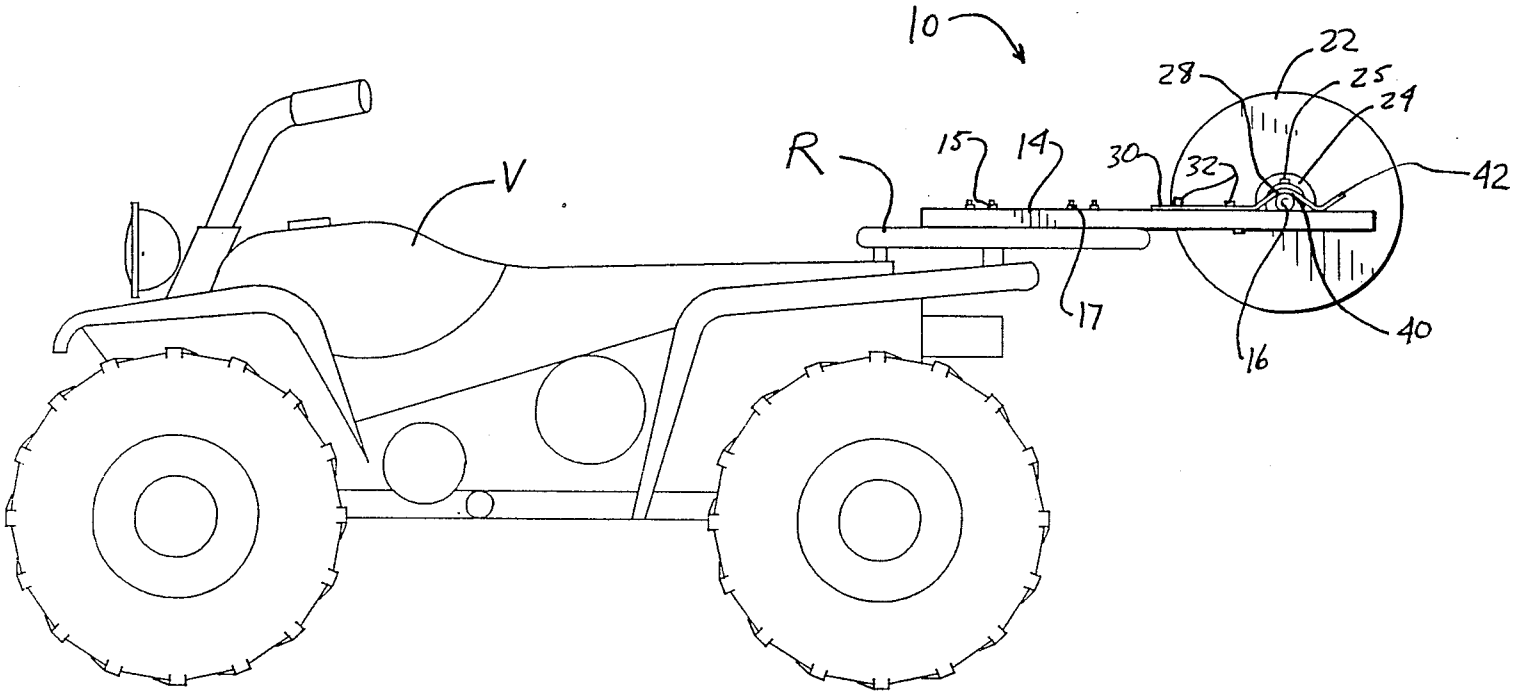
FIG. 5 is a side view illustrating the wire reel carrier mounted on a conventional all terrain type vehicle.

FIG. 5 is a side view which illustrates the wire reel carrier 10 mounted on the horizontal cargo rack R of a conventional A all terrain type vehicle V. As may now be understood, the present invention allows a single individual to safety and efficiently string barbed wire through the use of an ATV in a fencing operation.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A wire reel carrier for attachment to a horizontal cargo rack of an ATV, comprising:

a pair of spaced frame rails;

clamping means for securing said frame rails in spaced parallel horizontal orientation on said cargo rack;

an elongated rod adapted to rotatably mount a roll of wire, said rod extending transversely between said frame rail;

a pair of retaining plates, each having a central aperture received in said rod;

a pair of collars on rod for retaining said plates in a desired orientation on said rod;

and safety latch means for securing said rod to said frame rails and for releasing said rod on exertion of an excess force on said rod by a wire being strung from a roll supported on said rod.

2. The wire reel carrier of claim 1, wherein said safety latch means comprises a pair of safety latches releasably securing opposite ends of said rod to said frame rails.

3. The wire reel carrier of claim 2, wherein each of said safety latches comprise:

a spring steel strip;

fastening means securing a forward end of said strip in overlying relation on one of said frame rails;

an intermediate portion of said strip configured to form a clamping member frictionally clamping one end of said rod between said strip and said frame rail;

and a rearward end portion of said strip normally in abutment with said frame rail and being deformable upon exertion of an excess force on said rod to move away from said frame rail and release said rod from clamping engagement.

4. The wire reel carrier of claim 3, wherein said clamping member is formed by an arcuately bent portion of said strip.

5. The wire reel carrier of claim 4, wherein said rearward end portion of said strip terminates in an upwardly extending lever for releasing said rod from said safety latch.

6. A wire reel carrier for attachment to a horizontal cargo rack of an ATV, comprising:

a pair of spaced frame rails;

clamping means for securing said frame rails in spaced parallel horizontal orientation on said cargo rack;

an elongated rod adapted to rotatably mount a roll of wire, said rod extending transversely between said frame rail;

a pair of retaining plates, each having a central aperture received in said rod;

a pair of collars on rod for retaining said plates in a desired orientation on said rod;

a pair of safety latches releasably securing opposite ends of said rod to said frame rails for releasing said rod on exertion of an excess force on said rod by a wire being strung from a roll supported on said rod;

each of said safety latches including a spring steel strip;

fastening means securing a forward end of each of said strips in overlying relation on one of said frame rails;

an intermediate portion of each of said strips configured to form a clamping member frictionally clamping each end of said rod between one said strips and one of said frame rails;

and a rearward end portion of each of said strips normally in abutment with one of said frame rails and being deformable upon exertion of an excess force on said rod to move away from said frame rail and release said rod from clamping engagement.

7. The wire reel carrier of claim 6, wherein each of said clamping members are formed by an arcuately bent portion of one of said strips.

8. The wire reel carrier of claim 6, wherein said rearward end portions of said strips each terminate in an upwardly extending lever for releasing said rod from said safety latch.

9. A wire reel carrier for attachment to a horizontal cargo rack of an ATV, comprising:

a pair of spaced frame rails;

clamping means for securing said frame rails in spaced parallel horizontal orientation on said cargo rack;

an elongated rod adapted to rotatably mount a roll of wire, said rod extending transversely between said frame rail;

a pair of retaining plates, each having a central aperture received in said rod;

a pair of collars on rod for retaining said plates in a desired orientation on said rod;

a pair of safety latches releasably securing opposite ends of said rod to said frame rails for releasing said rod on exertion of an excess force on said rod by a wire being strung from a roll supported on said rod;

each of said safety latches including a spring steel strip;

fastening means securing a forward end of each of said strips in overlying relation on one of said frame rails;

an intermediate portion of each of said strips configured to form a clamping member frictionally clamping each end of said rod between one said strips and one of said frame rails;

each of said clamping members formed by an arcuately bent portion of one of said strips;

a rearward end portion of each of said strips normally in abutment with one of said frame rails and being deformable upon exertion of an excess force on said rod to move away from said frame rail and release said rod from clamping engagement;

and said rearward end portions of said strips each terminating in an upwardly extending lever for releasing said rod from said safety latch.

* * * * *